US012416439B2

(12) United States Patent
Kitagawa et al.

(10) Patent No.: US 12,416,439 B2
(45) Date of Patent: Sep. 16, 2025

(54) REFRIGERANT CYCLE APPARATUS

(71) Applicants: DAIKIN INDUSTRIES, LTD., Osaka (JP); DAIKIN EUROPE N.V., Ostend (BE)

(72) Inventors: Natsuko Kitagawa, Osaka (JP); Ryuuichi Toyota, Osaka (JP); Kazunari Fukagawa, Osaka (JP); Keiya Nagahara, Osaka (JP); Satoshi Kawano, Osaka (JP); Makoto Inoue, Osaka (JP); Kevin Cornelis, Ostend (BE)

(73) Assignee: DAIKIN INDUSTRIES, LTD., Osaka (JP)

( * ) Notice: Subject to any disclaimer, the term of this patent is extended or adjusted under 35 U.S.C. 154(b) by 408 days.

(21) Appl. No.: 17/973,701

(22) Filed: Oct. 26, 2022

(65) Prior Publication Data

US 2023/0052745 A1 Feb. 16, 2023

Related U.S. Application Data

(63) Continuation of application No. PCT/JP2020/019945, filed on May 20, 2020.

(51) Int. Cl.
*F25B 49/02* (2006.01)

(52) U.S. Cl.
CPC ..... *F25B 49/022* (2013.01); *F25B 2500/222* (2013.01); *F25B 2500/27* (2013.01); *F25B 2600/2515* (2013.01)

(58) Field of Classification Search
CPC ..... F25B 49/022; F25B 2500/222; F25B 2500/27; F25B 2600/2515
See application file for complete search history.

(56) References Cited

U.S. PATENT DOCUMENTS

2018/0187917 A1 7/2018 Suzuki et al.

FOREIGN PATENT DOCUMENTS

| | | | | |
|---|---|---|---|---|
| CN | 110822760 | A | | 2/2020 |
| EP | 3 480 347 | A1 | | 3/2019 |
| EP | 3460347 | A1 | * | 3/2019 |
| EP | 3 534 087 | A1 | | 9/2019 |
| JP | 2-140574 | A | † | 5/1990 |
| JP | 11-142004 | A | † | 5/1999 |
| JP | 2014224612 | A | * | 12/2014 |
| JP | 2015-209979 | A | † | 11/2015 |
| JP | 2019045129 | A | * | 3/2019 |

(Continued)

OTHER PUBLICATIONS

Marumoto et al., Air Conditioner, Dec. 4, 2014, JP2014224612A, Whole Document (Year: 2014).*

(Continued)

*Primary Examiner* — Larry L Furdge
(74) *Attorney, Agent, or Firm* — BIRCH, STEWART, KOLASCH & BIRCH, LLP

(57) ABSTRACT

A refrigerant cycle apparatus includes a refrigerant circuit that circulates a refrigerant, and a leak sensor that detects a refrigerant leaking from the refrigerant circuit, in which the refrigerant cycle apparatus includes, as an operating mode, a recovery mode for recognizing occurrence of an abnormality in the leak sensor and recovering a refrigerant to a predetermined location in the refrigerant circuit.

20 Claims, 6 Drawing Sheets

(56) References Cited

FOREIGN PATENT DOCUMENTS

| | | | |
|---|---|---|---|
| WO | WO 2013/038704 | A1 | 3/2013 |
| WO | WO 2017/026147 | A1 | 2/2017 |
| WO | 2019116437 | A1 † | 6/2019 |
| WO | F/2019116437 | A1 † | 6/2019 |

OTHER PUBLICATIONS

Yamada et al., Air Conditioning System, Mar. 22, 2019, JP2019045129A, Whole Document (Year: 2019).*

Extended European Search Report for European Application No. 20936720.0, dated May 23, 2023.

International Preliminary Report on Patentability and English translation of the Written Opinion of the International Searching Authority for International Application No. PCT/JP2020/019945, dated Dec. 1, 2022.

European Commitee for Standardization, "Refrigerating systems and heat pumps—Safety and environmental requirements—Part 3: Installation site and personal protection," BSI Standards Publication, EN378-3, 2016, 34 pages total.

European Communication pursuant to Rule 114(2) EPC for European Application No. 20936720.0, dated Feb. 20, 2024.

International Search Report, issued in PCT/JP2020/019945, PCT/ISA/210, dated Aug. 4, 2020.

Written Opinion of the International Searching Authority, issued in PCT/JP2020/019945, PCT/ISA/237, dated Aug. 4, 2020.

Publisher: BSI Standards Limited, Publication date: Dec. 31, 2016, Place of Publication: London, UK, Title: "Refrigerating systems and heat pumps—Safety and environmental requirements—Part 3: Installation site and personal protection", BS EN 378-3:2016, pp. submitted: 5-25.†

* cited by examiner
† cited by third party

REFRIGERANT RECOVERY MODE

| | CORRESPONDING INDOOR UNIT (FIRST INDOOR UNIT) | UNCORRESPONDING INDOOR UNIT (SECOND INDOOR UNIT) |
|---|---|---|
| FAILURE | ABNORMALITY DISPLAY A + SOUND + LIGHT | ABNORMALITY DISPLAY C |
| LIFETIME | ABNORMALITY DISPLAY B + SOUND + LIGHT | ABNORMALITY DISPLAY C |
| LIFETIME PRELIMINARY NOTIFICATION | MAINTENANCE DISPLAY | NO DISPLAY |

FIG. 5

OPERATION STOP MODE

| | CORRESPONDING INDOOR UNIT (FIRST INDOOR UNIT) | UNCORRESPONDING INDOOR UNIT (SECOND INDOOR UNIT) |
|---|---|---|
| FAILURE | ABNORMALITY DISPLAY A + SOUND + LIGHT | NO DISPLAY (ERROR DISPLAY WHEN OPERATING) |
| LIFETIME | ABNORMALITY DISPLAY B + SOUND + LIGHT | NO DISPLAY (ERROR DISPLAY WHEN OPERATING) |
| LIFETIME PRELIMINARY NOTIFICATION | MAINTENANCE DISPLAY | NO DISPLAY |

FIG. 6

REFRIGERANT CYCLE APPARATUS

CROSS REFERENCE TO RELATED APPLICATIONS

This application is a Continuation of PCT International Application No. PCT/JP2020/019945, filed on May 20, 2020, the contents of which are hereby expressly incorporated by reference into the present application.

TECHNICAL FIELD

The present disclosure relates to a refrigerant cycle apparatus.

BACKGROUND ART

Patent Literature 1 discloses an air conditioner including an outdoor unit, an indoor unit, and a refrigerant circuit that circulates a refrigerant between the outdoor unit and the indoor unit. The indoor unit includes a leak sensor that detects a refrigerant leaking from the refrigerant circuit. When an abnormality such as the leak sensor reaching the end of a life has occurred, the air conditioner of Patent Literature 1 is configured to stop a compressor to stop a refrigerant flow and notify a user of the event by display or sound.

SUMMARY

A refrigerant cycle apparatus of the present disclosure includes a refrigerant circuit that circulates a refrigerant, and a leak sensor that detects a refrigerant leaking from the refrigerant circuit, in which the refrigerant cycle apparatus includes, as an operating mode, a recovery mode for recognizing occurrence of an abnormality in the leak sensor and recovering a refrigerant to a predetermined location in the refrigerant circuit.

BRIEF DESCRIPTION OF THE DRAWINGS

FIG. 5 is a table illustrating notification modes when the recovery mode is selected.

FIG. 6 is a table illustrating notification modes when a stop mode is selected.

DESCRIPTION OF EMBODIMENTS

An embodiment of an air conditioning management system will be described in detail below with reference to the accompanying drawings.

Figure 1:
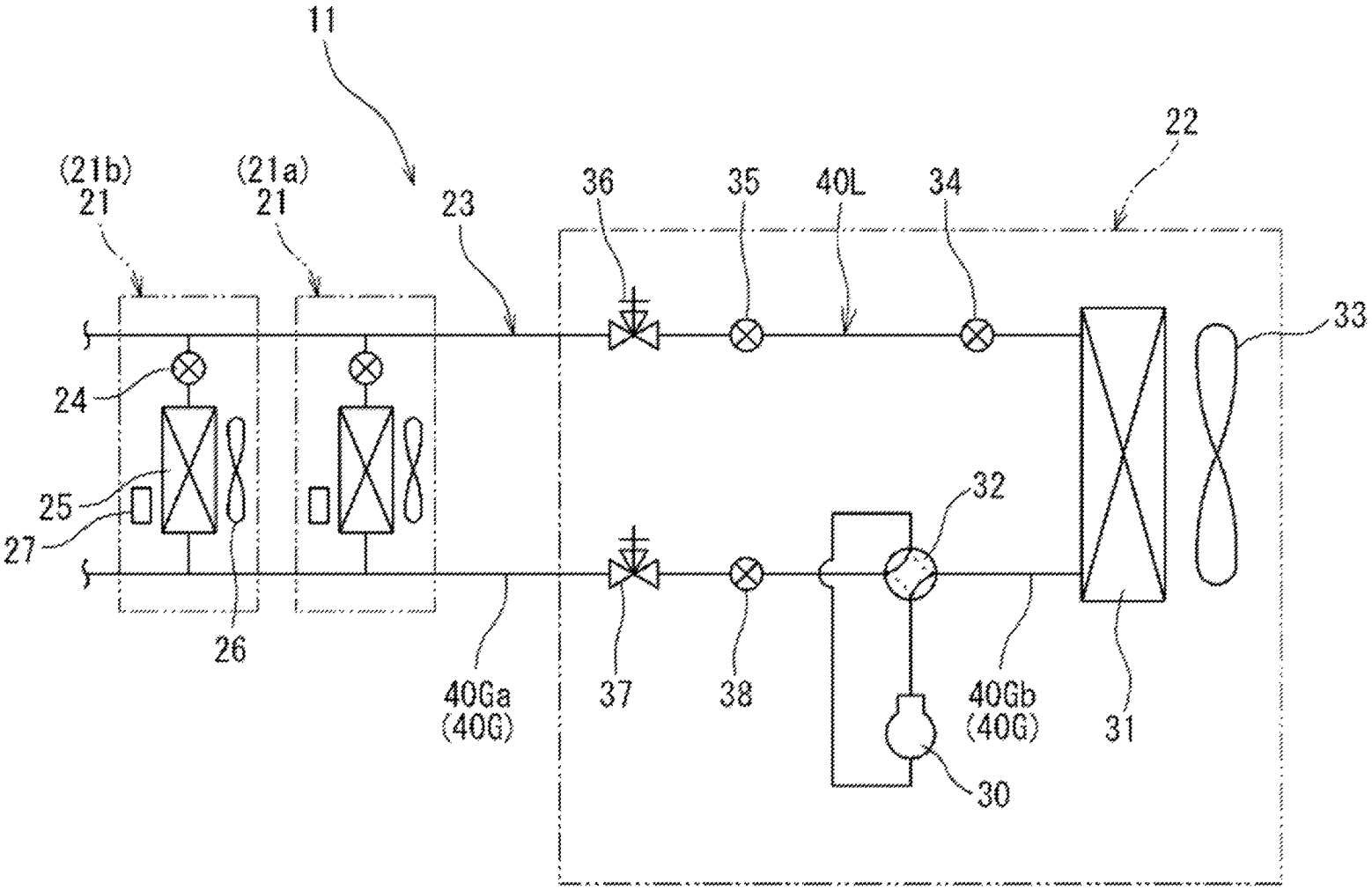
FIG. 1 is a schematic configuration diagram illustrating a refrigerant circuit of a refrigerant cycle apparatus according to an embodiment of the present disclosure.

FIG. 1 is a schematic configuration diagram illustrating a refrigerant circuit of a refrigerant cycle apparatus according to the embodiment of the present disclosure.

As illustrated in FIG. 1, a refrigerant cycle apparatus 11 performs vapor compression refrigeration cycle operation by circulating a refrigerant through a refrigerant circuit 23. Specifically, the refrigerant cycle apparatus 11 of the present embodiment is an air conditioner that adjusts temperature of indoor air. The air conditioner 11 includes an indoor unit (utilization-side unit) 21 and an outdoor unit (heat-source-side unit) 22. The air conditioner 11 of the present embodiment is a multi-type air conditioner in which a plurality of indoor units 21 is connected in parallel to the outdoor unit 22. In the present embodiment, as a refrigerant, a refrigerant having at least one of flammability, slight flammability, or toxicity, for example, an R32 refrigerant is used.

The refrigerant circuit 23 includes a compressor 30, a four-way switching valve 32, an outdoor heat exchanger (heat source heat exchanger) 31, an outdoor expansion valve 34, a liquid control valve 35, a liquid shutoff valve 36, indoor expansion valves 24, indoor heat exchangers (utilization heat exchangers) 25, a gas shutoff valve 37, a gas control valve 38, and refrigerant pipes 40L and 40G connecting these elements.

Each of the indoor units 21 includes an indoor expansion valve 24 and an indoor heat exchanger 25 included in the refrigerant circuit 23. The indoor expansion valve 24 is formed using an electric expansion valve capable of adjusting a refrigerant pressure and a refrigerant flow rate. The indoor heat exchanger 25 is a cross fin tube type or microchannel type heat exchanger, and is used for heat exchange with indoor air.

Each of the indoor units 21 further includes an indoor fan 26 and a leak sensor 27. The indoor fan 26 is configured to take indoor air into the indoor unit 21, cause the indoor heat exchanger 25 to exchange heat with the taken-in air, and then blow the air into the room. The indoor fan 26 includes a motor in which the number of rotations can be adjusted by inverter control.

The leak sensor 27 detects a refrigerant leaking from the refrigerant circuit 23. The leak sensor 27 is provided near a refrigerant pipe inside the indoor unit 21. Alternatively, the leak sensor 27 may be provided in a remote controller 42 to be described below, a ceiling, a wall, a floor, or the like in the room.

The outdoor unit 22 includes the compressor 30, the four-way switching valve 32, the outdoor heat exchanger 31, the outdoor expansion valve 34, the liquid control valve 35, the liquid shutoff valve 36, the gas shutoff valve 37, and the gas control valve 38 that are included in the refrigerant circuit 23.

The compressor 30 sucks a low-pressure gas refrigerant and discharges a high-pressure gas refrigerant. The compressor 30 includes a motor in which the number of rotations can be adjusted by inverter control. The compressor 30 is of a variable capacity type (ability variable type) having capacity (ability) that can be changed by inverter control of the motor. Alternatively, the compressor 30 may be of a constant capacity type. Furthermore, a plurality of compressors 30 may be provided. In this case, compressors of a variable capacity type and compressors of a constant capacity type may coexist.

The four-way switching valve 32 reverses a refrigerant flow in the refrigerant pipe, and switches and supplies the refrigerant discharged from the compressor 30 to one of the outdoor heat exchanger 31 and the indoor heat exchanger 25. As a result, the air conditioner 11 can switch between cooling operation and heating operation.

The outdoor heat exchanger 31 is, for example, a cross fin tube type or microchannel type heat exchanger, and is used for heat exchange with a refrigerant using air as a heat source.

The outdoor expansion valve 34 is formed using an electric expansion valve capable of adjusting a refrigerant pressure and a refrigerant flow rate.

The liquid shutoff valve 36 is a manual on-off valve. The gas shutoff valve 37 is also a manual on-off valve. The liquid shutoff valve 36 and the gas shutoff valve 37 are closed to block a refrigerant flow in the refrigerant pipes 40L and 40G, and are opened to allow a refrigerant flow in the refrigerant pipes 40L and 40G.

The liquid control valve 35 switches between a mode of allowing a refrigerant flow and a mode of blocking a refrigerant flow in the liquid refrigerant pipe 40L. The gas control valve 38 switches between a mode of allowing a refrigerant flow and a mode of blocking a refrigerant flow in the gas refrigerant pipe 40G. In the present embodiment, as the liquid control valve 35 and the gas control valve 38, electric expansion valves are used similarly to the outdoor expansion valve 34 and the indoor expansion valve 24.

The refrigerant pipes include the liquid refrigerant pipe 40L and the gas refrigerant pipe 40G. The liquid refrigerant pipe 40L is provided between a liquid side refrigerant inlet and outlet (hereinafter, also referred to as a "liquid side end") of the indoor heat exchanger 25 and a liquid side end of the outdoor heat exchanger 31. The gas refrigerant pipe 40G is provided between a gas side refrigerant inlet and outlet (hereinafter, also referred to as a "gas side end") of the indoor heat exchanger 25 and a gas side end of the outdoor heat exchanger 31. The liquid refrigerant pipe 40L includes the outdoor expansion valve 34, the gas control valve 38, the gas shutoff valve 37, and the indoor expansion valve 24. The gas refrigerant pipe 40G includes the compressor 30, the four-way switching valve 32, the gas control valve 38, and the gas shutoff valve 37. Note that, in the gas refrigerant pipe 40G, a portion on a suction side of the compressor 30 during cooling operation to be described below is referred to as a first gas refrigerant pipe 40Ga, and a portion on a discharge side of the compressor 30 is referred to as a second gas refrigerant pipe 40Gb.

The outdoor unit 22 further includes an outdoor fan 33. The outdoor fan 33 includes a motor in which the number of rotations can be adjusted by inverter control. The outdoor fan 33 is configured to take outdoor air into the outdoor unit 22, cause the outdoor heat exchanger 31 to exchange heat with the taken-in air, and then blow the air out of the outdoor unit 22.

During the cooling operation by the air conditioner 11 having the above configuration, the four-way switching valve 32 is held in a state illustrated using solid lines in FIG. 1. A high-temperature and high-pressure gaseous refrigerant discharged from the compressor 30 flows into the outdoor heat exchanger 31 through the four-way switching valve 32, and exchanges heat with outdoor air by operation of the outdoor fan 33 to dissipate heat. The refrigerant that has dissipated heat flows into each of the indoor units 21 through the outdoor expansion valve 34 and the liquid control valve 35 in a fully open state. In each of the indoor units 21, the refrigerant is decompressed to a predetermined low pressure by the indoor expansion valve 24, and the refrigerant exchanges heat with indoor air in the indoor heat exchanger 25 to evaporate. The indoor air cooled by the evaporation of the refrigerant is blown into the room by the indoor fan 26 to cool the room. The refrigerant evaporated in the indoor heat exchanger 25 returns to the outdoor unit 22 through the gas refrigerant pipe 40G, passes through the four-way switching valve 32, and is sucked into the compressor 30.

During heating operation by the air conditioner 11, the four-way switching valve 32 is held in a state illustrated using broken lines in FIG. 1. A high-temperature and high-pressure gaseous refrigerant discharged from the compressor 30 passes through the gas control valve 38 in a fully open state through the four-way switching valve 32, and flows into the indoor heat exchanger 25 of each of the indoor units 21. In the indoor heat exchanger 25, the refrigerant exchanges heat with indoor air to dissipate heat. The indoor air heated by the heat dissipation of the refrigerant is blown into the room by the indoor fan 26 to heat the room. The refrigerant liquefied in the indoor heat exchanger 25 returns to the outdoor unit 22 through the liquid refrigerant pipe 40L, is decompressed to a predetermined low pressure by the outdoor expansion valve 34, and further exchanges heat with outdoor air in the outdoor heat exchanger 31 to evaporate. Then, the refrigerant that has evaporated and vaporized by the outdoor heat exchanger 31 is sucked into the compressor 30 through the four-way switching valve 32.

Figure 2:
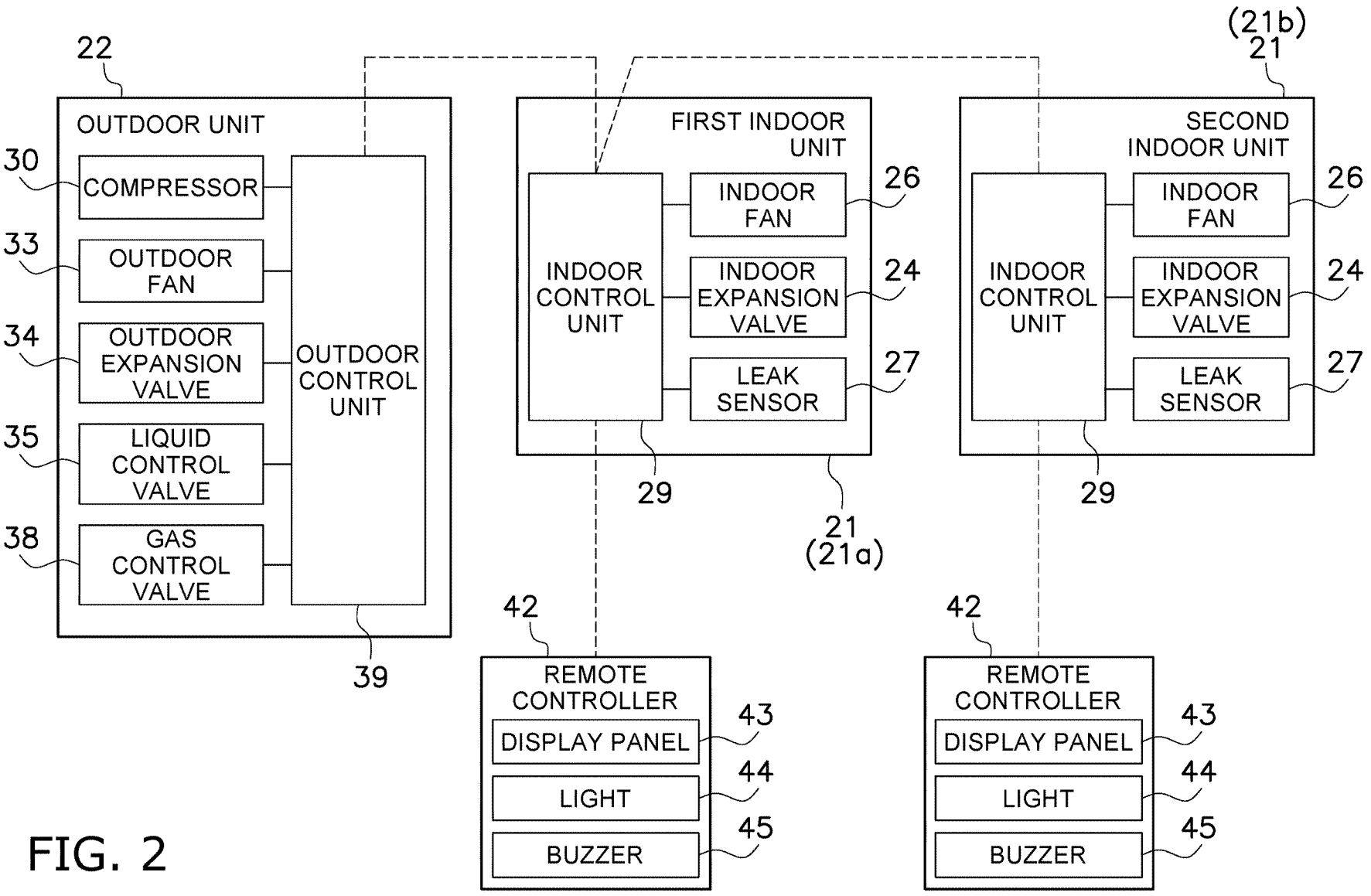
FIG. 2 is a block diagram of the refrigerant cycle apparatus.

FIG. 2 is a block diagram illustrating a configuration of the refrigerant cycle apparatus. FIG. 2 illustrates two indoor units 21*a* and 21*b*, which may be referred to as a first indoor unit 21*a* and a second indoor unit 21*b*.

In addition to the above configuration, each of the indoor units 21 includes an indoor control unit 29 and the remote controller 42 (hereinafter, also simply referred to as a "remote controller").

The indoor control unit 29 is formed using a microcomputer and the like including a central processing unit (CPU) and a memory. The indoor control unit 29 controls the operation of the indoor fan 26 and the indoor expansion valve 24 described above. The indoor control unit 29 also receives a signal transmitted from the leak sensor 27. The leak sensor 27 transmits, to the indoor control unit 29, a detection signal indicating whether there is a refrigerant leak from the refrigerant circuit 23 and a signal indicating that the leak sensor itself has failed.

The remote controller 42 is communicably connected to the indoor control unit 29. A user can operate the remote controller 42 to turn on or off the air conditioner 11, to input set temperature, and the like. The remote controller 42 according to the embodiment includes a display panel (display unit) 43, a light (light emitting unit) 44, and a buzzer (sound producing unit) 45. As will be described below, these components form "a notification unit" that, when the leak sensor 27 has failed or reached the end of a life, notify a user or a serviceman of the event.

The outdoor unit 22 includes an outdoor control unit 39 in addition to the above configuration.

The outdoor control unit 39 is formed using a microcomputer and the like including a CPU and a memory. The outdoor control unit 39 controls operation of the compressor 30, the outdoor fan 33, the outdoor expansion valve 34, the liquid control valve 35, and the gas control valve 38. The outdoor control unit 39 is communicably connected to a plurality of indoor control units 29.

[Operating Mode of Air Conditioner]

The air conditioner 11 of the present embodiment includes an operating mode performed when occurrence of an abnormality of the leak sensor 27 is recognized. Specifically, the air conditioner 11 includes, as operating modes, a "stop mode" in which the operation of the air conditioner 11 is stopped when occurrence of an abnormality of the leak sensor 27 is recognized, and a "recovery mode (pump-down mode)" in which a refrigerant is recovered to a predetermined location of the refrigerant circuit 23. The outdoor control unit 39 and the indoor control units 29 that is a control device of the air conditioner 11 perform the stop mode or the recovery mode.

The stop mode and the recovery mode are selected according to user's desire, an installation environment, or the like. Specifically, the outdoor control unit 39 of the air conditioner 11 includes a selection receiving unit formed using a dip switch or the like for receiving the selection of an operating mode. A serviceman or the like can select one of the operating modes by the selection receiving unit when the air conditioner 11 is installed.

The air conditioner 11 of the present embodiment recognizes that the leak sensor 27 has failed as an abnormality of the leak sensor 27. The leak sensor 27 transmits signals illustrated in the following (a) to (c) to the indoor control unit 29.

(a) Signal indicating that the leak sensor 27 has not detected a refrigerant leak (b) Signal indicating that the leak sensor 27 has detected a refrigerant leak (c) Signal indicating failure of the leak sensor 27

When receiving the above signals of (a) and (b), the indoor control unit 29 recognizes that the leak sensor 27 functions normally. When receiving the above signal of (c), the indoor control unit 29 recognizes that the leak sensor 27 has failed. The indoor control unit 29 also recognizes that the leak sensor 27 has failed when an unknown signal that does not correspond to any of the above (a) to (c) is received and when a signal from the leak sensor 27 is interrupted.

In addition to the failure as described above, the air conditioner 11 of the present embodiment also recognizes that the leak sensor 27 has reached the end of a life as an abnormality of the leak sensor 27. The leak sensor 27 has a lifetime that is a service life set for each product. For example, since deterioration of the leak sensor 27 progresses due to energization, the lifetime is set on the basis of the integrated energization time. The indoor control unit 29 counts integrated energization time from the time point when energization to the leak sensor 27 is started. Then, when the integrated energization time exceeds a predetermined first threshold value, the indoor control unit 29 recognizes that the leak sensor 27 has reached the end of a life. Furthermore, the indoor control unit 29 recognizes that the end of a life of the leak sensor 27 is close when the integrated energization time exceeds a predetermined second threshold value smaller than the first threshold value. The first threshold value may be, for example, 5 years, and the second threshold value may be, for example, 4 and a half years. However, the values of the first threshold value and the second threshold value are not limited, and are appropriately set according to the leak sensor 27 to be used.

[Processing in Recovery Mode]

(Recovery Mode Due to End of Life of Leak Sensor)

Hereinafter, a processing procedure of the recovery mode by the control device 29 and 39 will be described.

Figure 3:
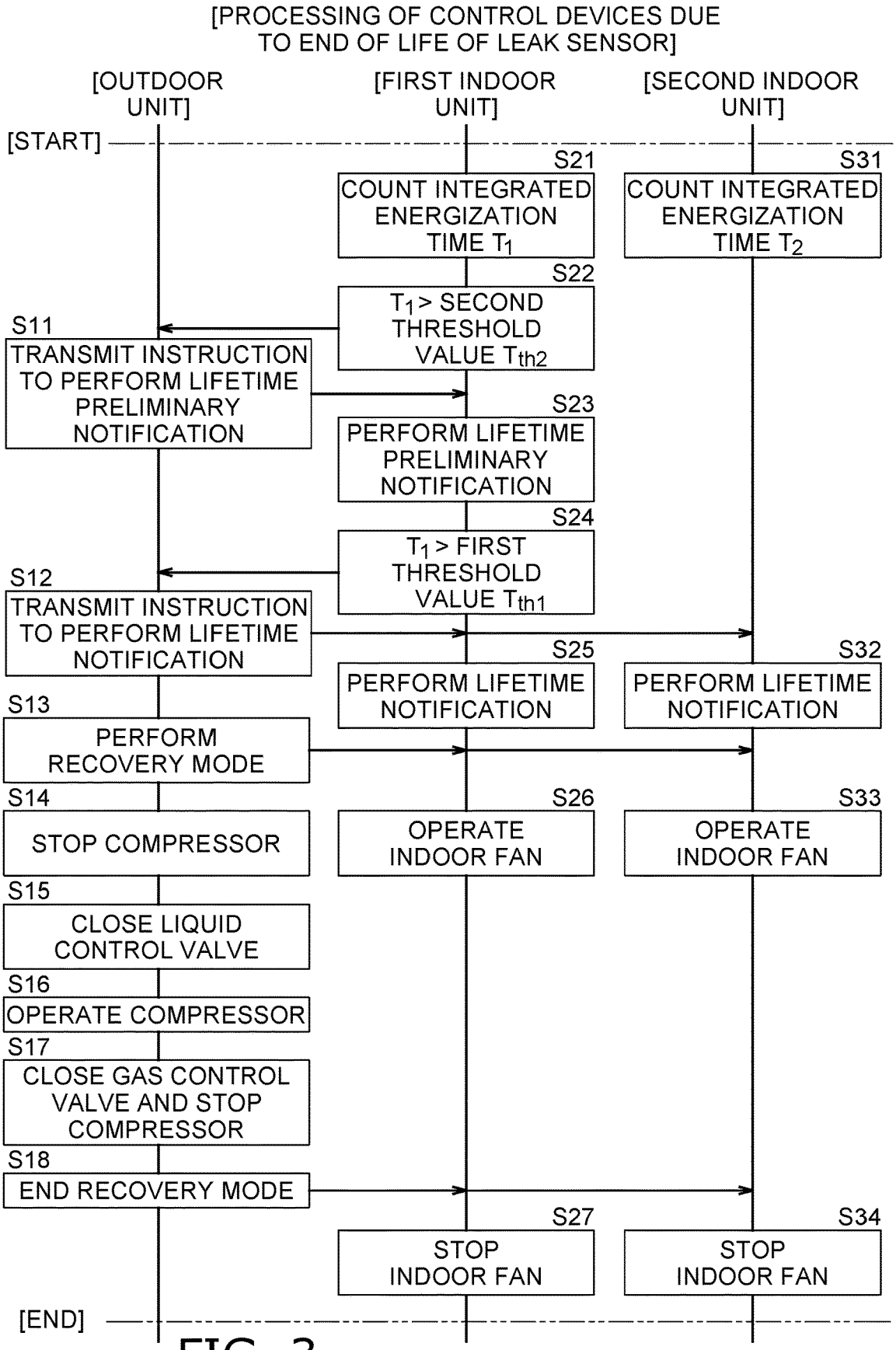
FIG. 3 is a flowchart illustrating a processing procedure of a control device when a recovery mode is performed due to the end of a life of a leak sensor.

FIG. 3 is a flowchart illustrating a processing procedure of the control device when the recovery mode is performed due to the end of a life of a leak sensor. In FIG. 3, the two indoor units 21 included in the air conditioner 11 (the first indoor unit 21*a* and the second indoor unit 21*b*) is focused on, and an example is illustrated in which the leak sensor (first leak sensor) 27 in the one first indoor unit 21*a* has reached the end of a life and the leak sensor 27 (second leak sensor) 27 in the other second indoor unit 21*b* has not reached the end of a life.

The indoor control units 29 of the first indoor unit 21*a* and the second indoor unit 21*b* count integrated energization time $T_1$ and $T_2$ of the leak sensors 27, respectively (steps S21 and S31). When the integrated energization time $T_1$ of the leak sensor 27 in the first indoor unit 21*a* exceeds a second threshold value $T_{th2}$, the indoor control unit 29 transmits the information to the outdoor control unit 39 of the outdoor unit 22 (step S22). The outdoor control unit 39 transmits an instruction to perform a lifetime preliminary notification to the indoor control unit 29 of the first indoor unit 21*a* on the basis of the information received from the indoor control unit 29 (step S11).

On the basis of the instruction from the outdoor control unit 39, the indoor control unit 29 of the first indoor unit 21*a* notifies that the end of a life of the leak sensor 27 is close using at least one of the display panel 43, the light 44, or the buzzer 45 in the remote controller 42 (step S23). A user, a serviceman, and the like can grasp that the end of a life of the leak sensor 27 of the first indoor unit 21*a* is close on the basis of the notification by the remote controller 42, and can take measures such as preparation for replacing the leak sensor 27 in advance. A specific mode of the notification will be described below.

Next, when the integrated energization time $T_1$ of the leak sensor 27 in the first indoor unit 21*a* exceeds a first threshold value $T_{th1}$, the indoor control unit 29 transmits the information to the outdoor control unit 39 (step S24). The outdoor control unit 39 transmits an instruction to perform a lifetime notification to each of the indoor control units 29 of the first indoor unit 21*a* and the second indoor unit 21*b* on the basis of the information received from the indoor control unit 29 (step S12).

Each of the indoor control units 29 of the first indoor unit 21*a* and the second indoor unit 21*b* that have received the instruction from the outdoor control unit 39 notifies that the leak sensor 27 of the first indoor unit 21*a* has reached the end of a life using at least one of the display panel 43, the light 44, or the buzzer 45 in the remote controller 42 (steps S25 and S32).

Note that the indoor control unit 29 of the first indoor unit 21*a* may perform the notification not by the instruction from the outdoor control unit 39 (steps S11 and S12) but by a fact that the integrated energization time $T_1$ of the leak sensor 27 exceeds the second threshold value $T_{th2}$ or the first threshold value $T_{th1}$.

Next, upon recognizing that the leak sensor 27 of the first indoor unit 21*a* has reached the end of a life, the outdoor control unit 39 performs the recovery mode. Specifically, when the air conditioner 11 is in the cooling operation or the heating operation, the outdoor control unit 39 temporarily stops the compressor 30 (step S14). Then, the four-way switching valve 32 is switched to a mode similar to the cooling operation, the liquid control valve 35 is closed, and then the compressor 30 is operated (steps S15 and S16). The outdoor control unit 39 transmits an instruction to operate the indoor fan 26 to each of the indoor control units 29, and each of the indoor control units 29 operates the indoor fan 26 when the indoor fan 26 is stopped and continues the operation as it is when the indoor fan 26 is operating (steps S26 and S33).

According to the above operation, a refrigerant in the refrigerant circuit 23 is recovered to the outdoor heat exchanger 31 side between the liquid control valve 35 and the gas control valve 38. The refrigerant is mainly recovered inside the outdoor heat exchanger 31. When the refrigerant is recovered to the outdoor heat exchanger 31 side, the outdoor control unit 39 closes the gas control valve 38 and stops the compressor 30 (step S17), and transmits a notification of the end of the recovery mode to the indoor control units 29 (step S18). Each of indoor heat exchangers 25 stops the indoor fan 26 on the basis of the notification of the end of the recovery mode. Thus, all processing related to the recovery mode ends.

As described above, since the air conditioner 11 according to the present embodiment recovers the refrigerant as the leak sensor 27 has reached the end of a life, leakage of the refrigerant can be prevented even if the refrigerant pipes 40L and 40G are damaged by subsequent replacement work of the leak sensor 27 or other maintenance work.

When the leak sensor 27 reaches the end of a life, the refrigerant may not be accurately detected even if the refrigerant leaks, and thus, during performance of the recovery mode, the indoor fan 26 is operated in each of the indoor units 21 to diffuse the leaking refrigerant, thereby preventing the refrigerant from staying in the room. However, the indoor fan 26 may not necessarily be operated during the performance of the recovery mode.

In the recovery mode, the refrigerant in the refrigerant circuit 23 may be recovered to an accumulator or a receiver (neither is illustrated) included in the refrigerant circuit 23 instead of or in addition to the outdoor heat exchanger 31.

Although the compressor 30 is temporarily stopped when the recovery mode is started in the above processing procedure, when the compressor 30 is operated by the cooling operation or the heating operation, the operating mode may be shifted to the recovery mode without the compressor 30 being stopped. In this case, the normal operation can be quickly shifted to the operation in the recovery mode.

Although a case where the leak sensor 27 of the first indoor unit 21*a* has reached the end of a life has been described in the above description, similar processing is performed when the leak sensor (second leak sensor) 27 of the second indoor unit 21*b* has reached the end of a life.

In a case where the air conditioner 11 includes three or more indoor units 21, the above processing of the first indoor unit 21*a* is performed in an indoor unit 21 in which the leak sensor 27 has reached the end of a life, and the above processing of the second indoor unit 21*b* is performed in indoor units 21 in which the leak sensors 27 have not reached the end of a life.

(Recovery Mode Due to Failure of Leak Sensor)

Figure 4:
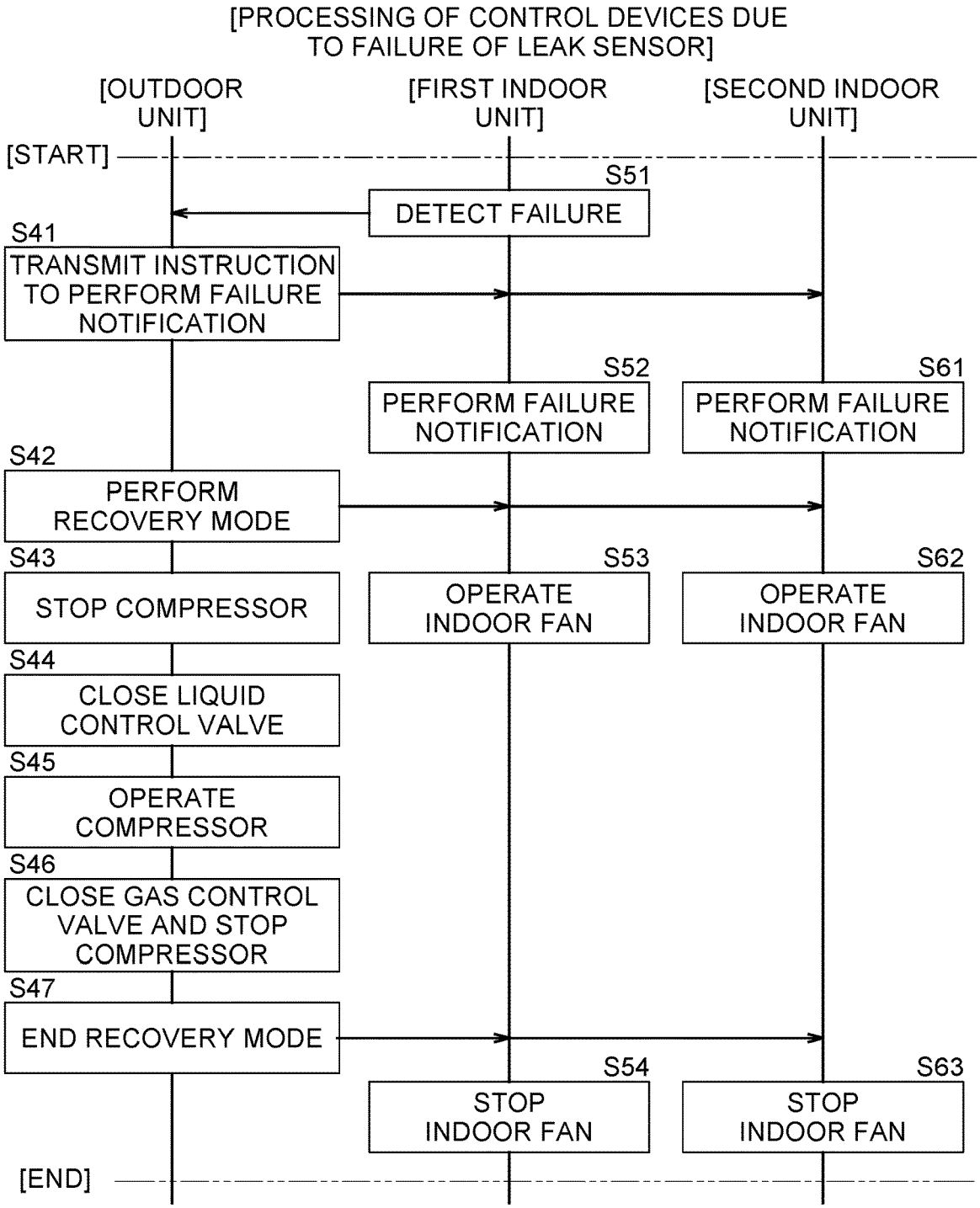
FIG. 4 is a flowchart illustrating a processing procedure of the control device when the recovery mode is performed due to failure of the leak sensor.

FIG. 4 is a flowchart illustrating a processing procedure of the control device when the recovery mode is performed due to failure of a leak sensor.

As described above, the indoor control units 29 of the first indoor unit 21*a* and the second indoor unit 21*b* receive signals indicating whether there is a refrigerant leak from the leak sensors 27. Upon recognizing failure of the leak sensor 27, the indoor control unit 29 in the first indoor unit 21*a* transmits the information to the outdoor control unit 39 (step S51).

The outdoor control unit 39 transmits an instruction to perform a failure notification to the indoor control units 29 of the first indoor unit 21*a* and the second indoor unit 21*b* on the basis of the information received from the indoor control unit 29 (step S41). On the basis of the instruction of the outdoor control unit 39, each of the indoor control units 29 of the first indoor unit 21*a* and the second indoor unit 21*b* notifies that the leak sensor 27 of the first indoor unit 21*a* has failed using at least one of the display panel 43, the light 44, or the buzzer 45 in the remote controller 42 (steps S53 and S62). A user, a serviceman, and the like can grasp that the leak sensor 27 has failed on the basis of the notification in the remote controller 42.

Next, upon recognizing that the leak sensor 27 has failed, the outdoor control unit 39 performs the recovery mode. The processing of the outdoor control unit 39 (S42 to S47) and the processing of the indoor control units 29 (S53 to S54 and S62 to S63) in the recovery mode are the same as the processing in the recovery mode due to the end of a life of the leak sensor 27.

[Processing in Stop Mode]

As described above, the air conditioner 11 of the present embodiment includes the recovery mode and the stop mode as the operating modes when an abnormality occurs in a leak sensor 27, and can select one of the two modes. When the stop mode is selected, the stop mode is performed instead of the recovery mode (steps S13 and S42) in FIGS. 3 and 4, and the control device 29 and 39 stop the compressor 30, the outdoor fan 33, the indoor fans 26, and the like and close the liquid control valve 35 and the gas control valve 38.

[Modes of Abnormality Notification]

FIG. 5 is a table illustrating notification modes when the recovery mode is selected. As described above, in the remote controllers 42 of the first indoor unit 21*a* and the second indoor unit 21*b*, when a leak sensor 27 has failed, reached the end of a life, or come close to the end of a life, a notification indicating these abnormalities is performed. FIG. 5 illustrates specific modes of the notification according to respective cases.

When the leak sensor 27 of the first indoor unit 21*a* has failed and the leak sensor 27 of the second indoor unit 21*b* has not failed, abnormality display A indicating the failure of the leak sensor 27 is displayed on the display panel 43 of the first indoor unit 21*a*, and at the same time, the light 44 emits light and the buzzer 45 sounds. At this time, abnormality display C indicating the abnormality of the leak sensor 27 of the other indoor unit (first indoor unit) 21*a* is displayed on the display panel 43 of the second indoor unit 21*b*, and the light 44 and the buzzer 45 do not operate.

As the first indoor unit 21*a* and the second indoor unit 21*b* perform different notifications in this manner, a user and a serviceman can recognize that a failure has occurred in the leak sensor 27 in the first indoor unit 21*a* by the notification from the first indoor unit 21*a*, and can recognize that an abnormality has occurred in an indoor unit other than the second indoor unit 21*b* connected to the second indoor unit 21*b* by the notification from the second indoor unit 21*b*. In a case where there are two indoor units, a user and a serviceman can recognize that an abnormality has occurred in the first indoor unit 21*a* by not only the notification from the first indoor unit 21*a* but also the notification from the second indoor unit 21*b*.

When the leak sensor 27 of the first indoor unit 21*a* has reached the end of a life and the leak sensor 27 of the second indoor unit 21*b* has not reached the end of a life, abnormality display B indicating that the leak sensor 27 has reached the end of a life is displayed on the display panel 43 of the first indoor unit 21*a*, and at the same time, the light 44 emits light and the buzzer 45 sounds. The abnormality display C indicating the abnormality of the leak sensor 27 of the other indoor unit (first indoor unit) 21*a* is displayed on the display panel 43 of the second indoor unit 21*b*, and the light 44 and the buzzer 45 do not operate.

As the first indoor unit 21*a* and the second indoor unit 21*b* perform different notifications in this manner, a user and a serviceman can recognize that the leak sensor 27 has reached the end of a life in the first indoor unit 21*a* by the notification from the first indoor unit 21*a*, and can recognize that an abnormality has occurred in an indoor unit other than the second indoor unit 21*b* connected to the second indoor unit 21*b* by the notification from the second indoor unit 21*b*. In a case where there are two indoor units, a user and a serviceman can recognize that an abnormality has occurred in the first indoor unit 21*a* by not only the notification from the first indoor unit 21*a* but also the notification from the second indoor unit 21*b*.

As described above, when an abnormality occurs in the leak sensor 27, the recovery mode is performed and the cooling operation and the heating operation by the air conditioner 11 are disabled, and the operation of the air conditioner 11 is substantially prohibited. Therefore, a user and the like can grasp that the operation of the air conditioner 11 is prohibited not only by the notification by the first indoor unit 21*a* but also by the notification by the second indoor unit 21*b*.

When the end of a life of the leak sensor 27 of the first indoor unit 21*a* is close and the end of a life of the leak sensor 27 of the second indoor unit 21*b* is not close, maintenance display indicating that the end of a life of the leak sensor 27 is close is displayed on the display panel 43 of the first indoor unit 21*a*, and the light 44 and the buzzer 45 do not operate. The display panel 43 of the second indoor unit 21*b* does not display the abnormality, and the light 44 and the buzzer 45 do not operate.

As described above, the notification is performed only by the first indoor unit 21*a* including the leak sensor 27 that has come close to the end of a life, so that a user and a serviceman can easily grasp that the end of a life of the leak sensor 27 of the first indoor unit 21*a* is close.

FIG. 6 is a table illustrating notification modes when the stop mode is selected.

When the leak sensor 27 of the first indoor unit 21*a* has failed and the leak sensor 27 of the second indoor unit 21*b* has not failed, the abnormality display A indicating the failure of the leak sensor 27 is displayed on the display panel 43 of the first indoor unit 21*a*, and at the same time, the light 44 emits light and the buzzer 45 sounds. At this time, the display panel 43 of the second indoor unit 21*b* does not display an indication of the abnormality, and the light 44 and the buzzer 45 do not operate. However, when a user or the like operates the remote controller 42, an error is displayed on the display panel 43. A user and a serviceman can recognize that the leak sensor 27 of the first indoor unit 21*a* has failed by the notification from the first indoor unit 21*a*. Furthermore, a user and a serviceman can recognize that an abnormality has occurred in the leak sensor 27 of an indoor unit other than the second indoor unit 21*b* connected to the second indoor unit 21*b* by the notification (error display) of the second indoor unit 21*b* when operating the remote controller 42. In a case where there are two indoor units, a user and a serviceman can recognize that an abnormality has occurred in the first indoor unit 21*a* by not only the notification from the first indoor unit 21*a* but also the notification from the second indoor unit 21*b*.

When the leak sensor 27 of the first indoor unit 21*a* has reached the end of a life and the leak sensor 27 of the second indoor unit 21*b* has not reached the end of a life, the abnormality display B indicating that the leak sensor 27 has reached the end of a life is displayed on the display panel 43 of the first indoor unit 21*a*, and at the same time, the light 44 emits light and the buzzer 45 sounds. At this time, the display panel 43 of the second indoor unit 21*b* does not display an indication of the abnormality, and the light 44 and the buzzer 45 do not operate. However, when a user or the like operates the remote controller 42, an error is displayed. A user and a serviceman can recognize that the leak sensor 27 of the first indoor unit 21*a* has reached the end of a life by the notification from the first indoor unit 21*a*. Furthermore, a user and a serviceman can recognize that an abnormality has occurred in the leak sensor 27 of an indoor unit other than the second indoor unit 21*b* connected to the second indoor unit 21*b* by the notification (error display) of the second indoor unit 21*b* when operating the remote controller 42. In a case where there are two indoor units, a user and a serviceman can recognize that an abnormality has occurred in the first indoor unit 21*a* by not only the notification from the first indoor unit 21*a* but also the notification from the second indoor unit 21*b*.

As described above, in the stop mode, when an abnormality occurs in the leak sensor 27 of the first indoor unit 21*a*, an error is displayed on the remote controller 42 of the second indoor unit 21*b* only when a user or the like operates the remote controller 42. As a result, only a user who attempts to operate the air conditioner 11 is notified of occurrence of an abnormality, and other user is not notified of the occurrence of the abnormality. Therefore, unnecessary notification is not performed to the other user, and the possibility of giving a sense of anxiety to the other user can be reduced.

When the end of a life of the leak sensor 27 of the first indoor unit 21*a* is close and the end of a life of the leak sensor 27 of the second indoor unit 21*b* is not close, the maintenance display indicating that the end of a life of the leak sensor 27 is close is displayed on the display panel 43 of the first indoor unit 21*a*, and the light 44 and the buzzer 45 do not operate. The display panel 43 of the second indoor unit 21*b* does not display the abnormality, and the light 44 and the buzzer 45 do not operate.

As described above, the notification is performed only by the first indoor unit 21*a* including the leak sensor 27 that has come close to the end of a life, so that a user and a serviceman can easily grasp that the end of a life of the leak sensor 27 of the first indoor unit 21*a* is close.

The abnormality display A, B, and C displayed on the display panel 43 of the remote controller 42 may be codes indicating an abnormality or contents of the abnormality. The maintenance display and the error display displayed on the display panel 43 may be display of codes or display of contents themselves.

The notification modes of the notification unit 43, 44, and 45 when an abnormality occurs in the leak sensor 27 can be variously changed. For example, the first indoor unit 21*a* in which an abnormality has occurred in the leak sensor 27 and the second indoor unit 21*b* in which no abnormality has occurred may perform notifications by different methods using the same means among the display panel 43, the light 44, and the buzzer 45. For example, when both the first indoor unit 21*a* and the second indoor unit 21*b* perform notifications using lights 44, one light 44 can be blinked and the other light 44 can be turned on. Furthermore, the first indoor unit 21*a* in which an abnormality has occurred in the leak sensor 27 and the second indoor unit 21*b* in which no abnormality has occurred may perform notifications using different means among the display panel 43, the light 44, and the buzzer 45. For example, the light 44 may be turned on in the first indoor unit 21*a*, and the buzzer 45 may be operated in the second indoor unit 21*b*.

Effects of Embodiments (1) A refrigerant cycle apparatus 11 of the above embodiment includes a refrigerant circuit 23 that circulates a refrigerant, and a leak sensor 27 that detects a refrigerant leaking from the refrigerant circuit 23, in which the refrigerant cycle apparatus 11 includes, as an operating mode, a recovery mode for recognizing occurrence of an abnormality in the leak sensor 27 and recovering a refrigerant to a predetermined location in the refrigerant circuit 23. As a result, leakage of the refrigerant from the refrigerant circuit 23 due to replacement of the leak sensor 27, other maintenance, or the like can be prevented.

(2) The refrigerant cycle apparatus 11 of the above embodiment further includes a control device (indoor control unit 29 and outdoor control unit 39) that control the refrigerant circuit 23. The control device 29 and 39 perform the recovery mode. The refrigerant cycle apparatus 11 further includes, as an operating mode, a stop mode for recognizing occurrence of an abnormality in the leak sensor 27 and stopping a refrigerant flow in the refrigerant circuit 23, in which the control device 29 and 39 perform the stop mode. The control device 29 and 39 receive selection of an operating mode to be performed when occurrence of an abnormality of the leak sensor 27 is recognized from the recovery mode and the stop mode. As a result, one of the recovery mode and the stop mode can be selected to be performed when an abnormality has occurred in the leak sensor 27 according to the installation environment of the refrigerant cycle apparatus 11 or the like.

(3) The refrigerant circuit 23 of the above embodiment includes a heat source heat exchanger 31, a utilization heat exchanger 25, a compressor 30, a liquid refrigerant pipe 40L connecting a liquid side end of the utilization heat exchanger 25 and a liquid side end of the heat source heat exchanger 31, a first gas refrigerant pipe 40Ga connecting a gas side end of the utilization heat exchanger 25 and a suction pipe of the compressor 30, a second gas refrigerant pipe 40Gb connecting a gas side end of the heat source heat exchanger 31 and a discharge pipe of the compressor 30, a liquid control valve 35 included in the liquid refrigerant pipe 40L, and a gas control valve 38 included in the first gas refrigerant pipe 40Ga, and the control device 29 and 39 close the liquid control valve 35 and operate the compressor 30 at a start of operation in the recovery mode, and close the gas control valve 38 at an end of operation in the recovery mode. As described above, a refrigerant can be recovered to the heat source heat exchanger 31 side between the liquid control valve 35 and the gas control valve 38 because the control device 29 and 39 close the liquid control valve 35 when the operation in the recovery mode is started, and the refrigerant can be prevented from flowing back to the utilization heat exchanger 25 side because the gas control valve 38 is closed when the operation in the recovery mode is ended.

(4) In the above embodiment, the abnormality of the leak sensor 27 is failure of the leak sensor 27 or an end of a life of the leak sensor 27. The refrigerant cycle apparatus 11 further includes a notification unit (display panel 43, light 44, and buzzer 45), in which the control device 29 and 39 recognize an end of a life of the leak sensor 27 when integrated energization time of the leak sensor 27 exceeds a predetermined first threshold value $T_{th1}$, and the notification unit 43, 44, and 45 perform different notifications between a case where the integrated energization time exceeds the first threshold value $T_{th1}$ and a case where the integrated energization time exceeds a predetermined second threshold value $T_{th2}$ shorter than the first threshold value $T_{th1}$. As a result, a serviceman and a user can grasp not only that the leak sensor 27 has reached the end of a life but also that the end of a life of the leak sensor 27 is close by the notification from the notification unit 43, 44, and 45.

(5) In the above embodiment, the refrigerant cycle apparatus 11 includes an outdoor unit 22 in which a refrigerant is circulated by the refrigerant circuit 23, and a first indoor unit 21*a* and a second indoor unit 21*b* in which a refrigerant is circulated by the refrigerant circuit 23. The first indoor unit 21*a* includes a leak sensor (first leak sensor) 27 and a notification unit (first notification unit) 43, 44, and 45, and the second indoor unit 21*b* includes a leak sensor (second leak sensor) 27 and a notification unit (second notification unit) 43, 44, and 45. When an abnormality has occurred in the leak sensor 27 in the first indoor unit 21*a* and no abnormality has occurred in the leak sensor 27 in the second indoor unit 21*b*, the notification unit 43, 44, and 45 of the first indoor unit 21*a* and the notification unit 43, 44, and 45 of the second indoor unit 21*b* perform different notifications. As described above, a serviceman and a user can grasp that the abnormality has occurred in the leak sensor 27 of the first indoor unit 21*a* not only by the notification unit 43, 44, and 45 of the first indoor unit 21*a* but also by the notification unit 43, 44, and 45 of the second indoor unit 21*b* because the notification unit 43, 44, and 45 of the first indoor unit 21*a* including the leak sensor 27 in which the abnormality has occurred and the notification unit 43, 44, and 45 of the second indoor unit 21*b* perform different notifications.

(6) In the above embodiment, the notification unit 43, 44, and 45 of the first indoor unit 21*a* and the notification unit 43, 44, and 45 of the second indoor unit 21*b* perform notifications by different means among a plurality of means including light, sound, and display, notifications by different combinations of the plurality of means, or notifications by different notification methods of a same means. As a result, when an abnormality has occurred in the leak sensor 27 of the first indoor unit 21*a*, a serviceman and a user can clearly identify the difference between a notification by the notification unit 43, 44, and 45 of the first indoor unit 21*a* and a notification by the notification unit 43, 44, and 45 of the second indoor unit 21*b*.

(7) In the above embodiment, the control device 29 and 39 perform the recovery mode while continuing the refrigerant flow in a case of recognizing occurrence of an abnormality in the leak sensor 27 while a refrigerant is circulating in the refrigerant circuit 23. In this case, the normal operation can be quickly shifted to the recovery mode when an abnormality has occurred in the leak sensor 27.

The present disclosure should not be limited to the above exemplification, but is intended to include any modification recited in claims within meanings and a scope equivalent to those of the claims.

REFERENCE SIGNS LIST

11 Refrigerant cycle apparatus (air conditioner)
21 Indoor unit
22 Outdoor unit
23 Refrigerant circuit
25 Indoor heat exchanger (utilization heat exchanger)
27 Leak sensor
29 Indoor control unit (control device)
30 Compressor
31 Outdoor heat exchanger (heat source heat exchanger)
35 Liquid control valve
38 Gas control valve
39 Outdoor control unit (control device)
40Ga First gas refrigerant pipe
40Gb Second gas refrigerant pipe
40L Liquid refrigerant pipe
43 Display panel (notification unit)
44 Light (notification unit)
45 Buzzer (notification unit)

$T_1$ Integrated energization time
$T_2$ Integrated energization time
$T_{th1}$ First threshold value
$T_{th2}$ Second threshold value

CITATION LIST

Patent Literature

Patent Literature 1: WO 2017/026147 A

The invention claimed is:

1. A refrigerant cycle apparatus comprising:

a refrigerant circuit that circulates a refrigerant; and a leak sensor that detects a refrigerant leaking from the refrigerant circuit, wherein the refrigerant cycle apparatus includes an operating mode that is performed when recognizing an occurrence of an abnormality in the leak sensor, and the operating mode includes a recovery mode for recovering a refrigerant to a predetermined location in the refrigerant circuit.

2. The refrigerant cycle apparatus according to claim 1 further comprising a controller that controls the refrigerant circuit, wherein the controller performs the recovery mode.

3. The refrigerant cycle apparatus according to claim 2 further comprising, as an operating mode, a stop mode for recognizing occurrence of an abnormality in the leak sensor and stopping a refrigerant flow in the refrigerant circuit, wherein the controller performs the stop mode.

4. The refrigerant cycle apparatus according to claim 3, wherein the controller receives selection of an operating mode to be performed when occurrence of an abnormality of the leak sensor is recognized from the recovery mode and the stop mode.

5. The refrigerant cycle apparatus according to claim 2, wherein the refrigerant circuit comprises a heat source heat exchanger, a utilization heat exchanger, a compressor, a liquid refrigerant pipe connecting a liquid side end of the utilization heat exchanger and a liquid side end of the heat source heat exchanger, a first gas refrigerant pipe connecting a gas side end of the utilization heat exchanger and a suction pipe of the compressor, a second gas refrigerant pipe connecting a gas side end of the heat source heat exchanger and a discharge pipe of the compressor, a liquid control valve included in the liquid refrigerant pipe, and a gas control valve included in the first gas refrigerant pipe, and the controller closes the liquid control valve and operates the compressor at a start of operation in the recovery mode, and closes the gas control valve at an end of operation in the recovery mode.

6. The refrigerant cycle apparatus according to claim 1, wherein the abnormality is failure of the leak sensor or an end of a life of the leak sensor.

7. The refrigerant cycle apparatus according to claim 6 further comprising a notification unit, wherein the refrigerant cycle apparatus recognizes an end of a life of the leak sensor when integrated energization time of the leak sensor exceeds a predetermined first threshold value, and the notification unit performs different notifications between a case where the integrated energization time exceeds the first threshold value and a case where the integrated energization time exceeds a predetermined second threshold value shorter than the first threshold value.

8. The refrigerant cycle apparatus according to claim 1 further comprising:

an outdoor unit in which a refrigerant is circulated by the refrigerant circuit; and a first indoor unit and a second indoor unit in which a refrigerant is circulated by the refrigerant circuit, wherein the first indoor unit includes a first leak sensor and a first notification unit, and the second indoor unit includes a second leak sensor and a second notification unit, and wherein, when an abnormality has occurred in the first leak sensor and no abnormality has occurred in the second leak sensor, the first notification unit and the second notification unit perform different notifications.

9. The refrigerant cycle apparatus according to claim 8, wherein the first notification unit and the second notification unit perform notifications by different means among a plurality of means including light, sound, and display, notifications by different combinations of the plurality of means, or notifications by different notification methods of a same means.

10. The refrigerant cycle apparatus according to claim 2, wherein the controller performs the recovery mode while continuing the refrigerant flow in a case of recognizing occurrence of an abnormality in the leak sensor while a refrigerant is circulating in the refrigerant circuit.

11. The refrigerant cycle apparatus according to claim 3, wherein the refrigerant circuit comprises a heat source heat exchanger, a utilization heat exchanger, a compressor, a liquid refrigerant pipe connecting a liquid side end of the utilization heat exchanger and a liquid side end of the heat source heat exchanger, a first gas refrigerant pipe connecting a gas side end of the utilization heat exchanger and a suction pipe of the compressor, a second gas refrigerant pipe connecting a gas side end of the heat source heat exchanger and a discharge pipe of the compressor, a liquid control valve included in the liquid refrigerant pipe, and a gas control valve included in the first gas refrigerant pipe, and the controller closes the liquid control valve and operates the compressor at a start of operation in the recovery mode, and closes the gas control valve at an end of operation in the recovery mode.

12. The refrigerant cycle apparatus according to claim 4, wherein the refrigerant circuit comprises a heat source heat exchanger, a utilization heat exchanger, a compressor, a liquid refrigerant pipe connecting a liquid side end of the utilization heat exchanger and a liquid side end of the heat source heat exchanger, a first gas refrigerant pipe connecting a gas side end of the utilization heat exchanger and a suction pipe of the compressor, a second gas refrigerant pipe connecting a gas side end of the heat source heat exchanger and a discharge pipe of the compressor, a liquid control valve included in the liquid refrigerant pipe, and a gas control valve included in the first gas refrigerant pipe, and the controller closes the liquid control valve and operates the compressor at a start of operation in the recovery mode, and closes the gas control valve at an end of operation in the recovery mode.

13. The refrigerant cycle apparatus according to claim 2, wherein the abnormality is failure of the leak sensor or an end of a life of the leak sensor.

14. The refrigerant cycle apparatus according to claim 3, wherein the abnormality is failure of the leak sensor or an end of a life of the leak sensor.

15. The refrigerant cycle apparatus according to claim 4, wherein the abnormality is failure of the leak sensor or an end of a life of the leak sensor.

16. The refrigerant cycle apparatus according to claim 5, wherein the abnormality is failure of the leak sensor or an end of a life of the leak sensor.

17. The refrigerant cycle apparatus according to claim 2 further comprising:

an outdoor unit in which a refrigerant is circulated by the refrigerant circuit; and a first indoor unit and a second indoor unit in which a refrigerant is circulated by the refrigerant circuit, wherein the first indoor unit includes a first leak sensor and a first notification unit, and the second indoor unit includes a second leak sensor and a second notification unit, and wherein, when an abnormality has occurred in the first leak sensor and no abnormality has occurred in the second leak sensor, the first notification unit and the second notification unit perform different notifications.

18. The refrigerant cycle apparatus according to claim 3 further comprising:

an outdoor unit in which a refrigerant is circulated by the refrigerant circuit; and a first indoor unit and a second indoor unit in which a refrigerant is circulated by the refrigerant circuit, wherein the first indoor unit includes a first leak sensor and a first notification unit, and the second indoor unit includes a second leak sensor and a second notification unit, and wherein, when an abnormality has occurred in the first leak sensor and no abnormality has occurred in the second leak sensor, the first notification unit and the second notification unit perform different notifications.

19. The refrigerant cycle apparatus according to claim 4 further comprising:

an outdoor unit in which a refrigerant is circulated by the refrigerant circuit; and a first indoor unit and a second indoor unit in which a refrigerant is circulated by the refrigerant circuit, wherein the first indoor unit includes a first leak sensor and a first notification unit, and the second indoor unit includes a second leak sensor and a second notification unit, and wherein, when an abnormality has occurred in the first leak sensor and no abnormality has occurred in the second leak sensor, the first notification unit and the second notification unit perform different notifications.

20. The refrigerant cycle apparatus according to claim 5 further comprising:

an outdoor unit in which a refrigerant is circulated by the refrigerant circuit; and a first indoor unit and a second indoor unit in which a refrigerant is circulated by the refrigerant circuit, wherein the first indoor unit includes a first leak sensor and a first notification unit, and the second indoor unit includes a second leak sensor and a second notification unit, and wherein, when an abnormality has occurred in the first leak sensor and no abnormality has occurred in the second leak sensor, the first notification unit and the second notification unit perform different notifications.

* * * * *